US008537083B2

(12) United States Patent
Nakatsuka

(10) Patent No.: US 8,537,083 B2
(45) Date of Patent: Sep. 17, 2013

(54) METHOD FOR CONTROLLING COMMON VOLTAGE OF THE LIQUID CRYSTAL DISPLAY DEVICE

(75) Inventor: Hitoshi Nakatsuka, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 780 days.

(21) Appl. No.: 12/313,719

(22) Filed: Nov. 24, 2008

(65) Prior Publication Data

US 2009/0135124 A1 May 28, 2009

(30) Foreign Application Priority Data

Nov. 27, 2007 (JP) ..... 2007-306473

(51) Int. Cl.
*G09G 3/36* (2006.01)

(52) U.S. Cl.
USPC ..... 345/87; 345/211

(58) Field of Classification Search
USPC ..... 345/94, 98, 87, 211
See application file for complete search history.

(56) References Cited

U.S. PATENT DOCUMENTS 5,646,643 A * 7/1997 Hirai et al. ..... 345/100
5,831,605 A * 11/1998 Yasui et al. ..... 345/211
6,222,516 B1 4/2001 Oda et al.
2002/0063703 A1* 5/2002 Furuhashi et al. ..... 345/212
2005/0231456 A1* 10/2005 Nakamura et al. ..... 345/98
2005/0253836 A1 11/2005 Kim
2006/0061719 A1* 3/2006 Tomioka et al. ..... 349/123
2006/0268212 A1* 11/2006 Someya et al. ..... 349/144
2007/0002005 A1* 1/2007 Kim et al. ..... 345/103
2007/0024565 A1 2/2007 Choi
2007/0291190 A1* 12/2007 Shin et al. ..... 349/37

FOREIGN PATENT DOCUMENTS

JP 2000-214431 A 8/2000
JP 2007-140384 A 6/2007

OTHER PUBLICATIONS

The extended European Search Report, dated Sep. 4, 2009.

* cited by examiner

*Primary Examiner* — Allison Walthall
(74) *Attorney, Agent, or Firm* — Yokoi & Co., U.S.A., Inc.; Toshiyuki Yokoi

(57) ABSTRACT

The liquid crystal display device 100 has a matrix arrangement of pixels which are formed by a liquid crystal layer, display electrodes disposed across the liquid crystal layer, and a counter electrode made of a transparent material and represents a tone (gray scale level) per pixel by applying a drive voltage to the liquid crystal layer, the drive voltage corresponding to a potential difference between each of the display electrodes and the counter electrode. The device also includes a common voltage supplying part 42 that detects a charge in a certain area T1 of the counter electrode 15 and compares a feedback voltage corresponding to the detected charge in the area, thereby providing common voltage Vcom feedback control. Consequently, flickers on the screen can be prevented by common voltage Vcom feedback control.

2 Claims, 10 Drawing Sheets

METHOD FOR CONTROLLING COMMON VOLTAGE OF THE LIQUID CRYSTAL DISPLAY DEVICE

CROSS REFERENCE TO RELATED APPLICATIONS

The present application is related to the Japan Utility Model Application No. 2007-306473, filed Nov. 27, 2007, the entire disclosure of which is expressly incorporated by reference herein.

BACKGROUND OF THE INVENTION

1. Field of the Invention

The present invention relates to a liquid crystal display device and, particularly, to such device in which the charge on a counter electrode is controlled not to vary.

2. Description of the Related Art

A liquid crystal display device displays an image by means of liquid crystal. The liquid crystal display device includes an upper glass substrate, a lower glass substrate, and a liquid crystal layer sandwiched between these substrates. Of the upper glass substrate, on its under surface facing the liquid crystal layer, a counter electrode for applying a common voltage Vcom to the liquid crystal layer and a transmission line X for supplying the common voltage Vcom to the counter electrode are situated. Of the lower glass substrate, on its upper surface facing the liquid crystal layer, a display electrode applying a display voltage to the liquid crystal layer and a transmission line Y for supplying a source voltage to the display electrode are situated.

In the arrangement as above, when a source voltage is applied to the display electrode and a common voltage Vcom is applied to the counter electrode through the transmission line X, a drive voltage determined by a potential difference between the applied source voltage and common voltage Vcom is applied to the liquid crystal layer.

The common voltage Vcom serves as a reference voltage for the voltage that is applied to the liquid crystal layer. For example, in a liquid crystal display device using an inversion driving method, with respect to the counter electrode, the polarity of charge supplied to the display electrode is inverted at given intervals. In this case, a drive voltage corresponding to a voltage difference between the display electrode and the common electrode in each interval is applied to the liquid crystal layer. For this reason, it is desired that the common voltage Vcom is stable for driving by the liquid crystal display device.

In the above arrangement of the liquid crystal display device, a common voltage Vcom that is applied to the counter electrode may become nonuniform. This is due to varying impedance of the counter electrode and varying wiring lengths of the transmission line through which the common voltage Vcom is supplied to the counter electrode. Nonuniform common voltage Vcom that is applied to the counter electrode results in nonuniformity in the drive voltage Vd per pixel applied to the liquid crystal layer and gives rise to a flicker in the screen and uneven image quality. One possible method for preventing an increase of transmission line impedance is to increase the wire diameter of the transmission line. However, this method is not practicable, because the larger the wire diameter, the smaller will be the aperture ratio of the glass substrate.

A technique concerning a common line wired on the glass substrate for transmitting a common signal is known.

Patent Document 1 (Japanese Published Unexamined Patent Application No. 2000-214431) discloses a semiconductor integrated circuit device having common output terminals and segment output terminals which output electric signals to drive a liquid crystal display panel, wherein the common output terminals are arranged virtually evenly at both opposite sides of the semiconductor integrated circuit.

According to Patent Document 2 (Japanese Published Unexamined Patent Application No. 2007-140384), in order to stabilize a common voltage Vcom, a supply voltage used as a reference for the common voltage Vcom that is applied to the counter electrode is supplied from a power supply circuit provided outside the liquid crystal panel.

The technique disclosed in the above Patent Document 1 provides even wiring lengths of the common line for transmitting a common signal. However, the impedance of the counter electrode is not uniform. There is still a possibility of failing to keep the common voltage Vcom applied to the counter electrode constant.

The technique disclosed in Patent Document 2 provides stable supply of the reference voltage for a common voltage Vcom. However, the wiring lengths of the transmission line are uneven and impedance differs from one portion to another of the counter electrode. Hence, there is still a possibility of failing to keep the common voltage Vcom applied to the counter electrode constant.

BRIEF SUMMARY OF THE INVENTION

The present invention provides a liquid crystal display device that prevents nonuniformity in a displayed image and enhances display quality.

An aspect of the present invention resides in a liquid crystal display device, comprising, pixels that are formed by a liquid crystal layer, display electrodes disposed across the liquid crystal layer, a counter electrode made of a transparent material, and which displays an image by applying a drive voltage to said liquid crystal layer, the drive voltage corresponding to a potential difference between each of said display electrodes and said counter electrode, a source voltage supplying part that supplies source voltages based on image signals to the display electrodes; a feedback voltage supplying part that detects a charge in a certain area in the counter electrode and outputs a feedback voltage corresponding to the detected charge in that area; and a common voltage supplying part that compares the feedback voltage with a reference voltage, feedback controls the common voltage based on the result of the comparison, and supplies the thus controlled common voltage to the counter electrode.

In this aspect of the invention, the liquid crystal display device configured as above displays an image using the pixels formed by the display electrodes disposed across the liquid crystal layer, the counter electrode made of a transparent material, and the liquid crystal layer sandwiched between the display electrodes and the counter electrode. The feedback voltage supplying part detects a charge in a certain area of the counter electrode and supplies a feedback voltage corresponding to the detected charge in that area to the common voltage supplying part. The common voltage supplying part compares the feedback voltage with a reference voltage, feedback controls the common voltage to be applied to the counter electrode based on the result of the comparison, and outputs the thus controlled common voltage to the counter electrode.

On the counter electrode, the area where the charge is detected is, for example, an area where the voltage has a larger pulsation than in other areas. When the common voltage is supplied from both lateral sides of the counter electrode, the common voltage varies across the counter electrode due to varying wiring lengths for charge supply and varying impedance of the counter electrode itself However, feedback control of the common voltage contributes to reducing the variation of the common voltage, thus preventing uneven image quality such as flickers and enhancing the display quality. Area termed here is not intended to define a particular portion of the counter electrode.

According to the main aspect of the invention as described above, it is possible to prevent nonuniformity of image quality on the screen and enhance the display quality.

In a more specific example of the invention, the liquid crystal display device includes a plurality of common voltage supplying parts, wherein the plurality of common voltage supplying parts perform common voltage feedback control individually for certain areas of the counter electrode based on feedback voltages from these areas.

The invention configured as above provides common voltage feedback control in a plurality of areas of the counter electrode, thus achieving a uniform distribution of the common voltage across the counter electrode.

In a more specific example of the invention, the above common voltage supplying parts perform feedback control of the common voltage applied to both lateral marginal areas of the counter electrode and the common voltage applied to a virtually center area of the counter electrode.

In the center area of the counter electrode, common voltage pulsation tends to be larger in the charge distribution. In the invention configured as above, because of common voltage feedback control in this center area and both lateral marginal areas of the counter electrode, a uniform distribution of the common voltage across the counter electrode is obtained.

In the specific example described above, a uniform distribution of the common voltage across the counter electrode is obtained and this enhances image quality.

In a more specific example of the invention, the common voltage supplying part is comprised of an operational amplifier that compares a feedback voltage input thereto with a reference voltage and performs common voltage feedback control based on the result of the comparison.

In the invention configured as above, common voltage feedback control is carried out by the operational amplifier and, therefore, realized in a simple structure.

Further, in a more specific example of the invention, the liquid crystal display device is configured such that the liquid crystal layer is sandwiched between two glass substrates, the counter electrode being situated on one of the two glass plates and the display electrodes being disposed on the other one of the two glass plates. The feedback voltage supplying part is comprised of a conductor wire wired on the one of the glass plates, making an electrical connection between the operational amplifier and the counter electrode.

The operational amplifier has a high input impedance and is hence capable of comparing a feedback voltage with the reference voltage, even if the diameter of the feedback line for the feedback voltage is made fine, thus increasing the wiring resistance. In the invention configured as above, by using the feedback line with a fine diameter, it can be prevented that the feedback line degrades the aperture ratio of the glass substrate.

In a more specific example of the invention, the source voltage supplying part is configured to supply the source voltages to the display electrodes, while inverting the polarity of the source voltage on a pixel by pixel basis.

In a liquid crystal driving method in which the polarity of the voltage applied is inverted pixel by pixel, polarity imbalance of magnetic fields produced in the display electrodes has a great influence on the pulsation of a common voltage in the counter electrode. For example, if adjacent pixels have opposite polarities and substantially the same level of charge is applied to their display electrodes, the polarities of these pixels cancel each other, thus having no effect on the common voltage. However, if adjacent pixels have the same polarity or there is a very large difference between the charges on these pixels, electric fields with unbalanced polarity are produced in their display electrodes, which affects the common voltage and results in a significant unevenness in image quality.

The present invention is, therefore, particularly effective for this driving method in which the polarity is inverted pixel by pixel, and makes it possible to effectively prevent uneven image quality on the screen.

In a more specific example of the invention, the source voltage supplying part is comprised of a thin film transistor serving as a switch to supply a source voltage to each display electrode, a source driver IC to supply the source voltage to a source electrode of the thin film transistor, a gate driver IC to supply a gate signal to a gate electrode of the thin film transistor and turn the transistor on; and a controller IC to control driving of the source driver IC and the gate driver IC, wherein the operational amplifier is installed in the controller IC.

In the invention configured as above, the operational amplifier is installed in the controller IC. Hence, space can be used efficiently and the liquid crystal display device can be made compact.

In a more specific example of the invention, the liquid crystal display device is configured such that the liquid crystal layer is sandwiched between two glass substrates, the counter electrode being situated on one of the two glass plates and the display electrodes being disposed on the other one of the two glass plates, wherein the common voltage supplying part includes a plurality of operational amplifiers that compare a feedback voltage input thereto with a reference voltage and perform common voltage feedback control based on the result of the comparison, wherein the feedback voltage is received through wires wired on the one of the glass substrates, these wires making electrical connections between certain areas of the counter electrode and the operational amplifiers, wherein the source voltage supplying part is comprised of a thin film transistor serving as a switch to supply a source voltage to each display electrode, a source driver IC to supply a source voltage based on an input image signal to a source electrode of the thin film transistor, a gate driver IC to supply a gate signal to a gate electrode of the thin film transistor and turn the transistor on; and a controller IC to control driving of the source driver IC and the gate driver IC, and the source voltage supplying part supplying the source voltages to the display electrodes, while inverting the polarity of the source voltages for each column of pixels, wherein the operational amplifiers are installed in the controller IC.

It is obvious that such a more specific configuration produces the same effect as described in the foregoing descriptions of the invention.

DETAILED DESCRIPTION OF THE INVENTION

In the following, embodiments of the present invention will be described in order noted below. In the figures, the same or corresponding components are assigned the same reference numbers and description thereof is not repeated.

1. First Embodiment
   1.1 Structure of Liquid Crystal Display Device
   1.2 Effect of Liquid Crystal Display Device
2. Second Embodiment
3. Modification Examples

1. First Embodiment

1.1 Structure of Liquid Crystal Display Device

A liquid crystal display device according to a first embodiment of the invention generates a drive voltage Vd based on an image signal (video signal and synchronization signal) supplied. Application of the generated drive voltage Vd to pixels varies the light transmittance across the pixels and an image is displayed by the multiple pixels having different transmittance values. The liquid crystal display device carries out feedback control of a common voltage Vcom serving as a reference for the drive voltage Vd, thereby avoiding nonuniformity in a displayed image and enhancing display quality. The following description of the present embodiment assumes that the liquid crystal display device is an active matrix type. However, the present invention can be applied to any liquid crystal display device that uses a common voltage Vcom to drive liquid crystal, even adopting any other driving method.

Figure 1:
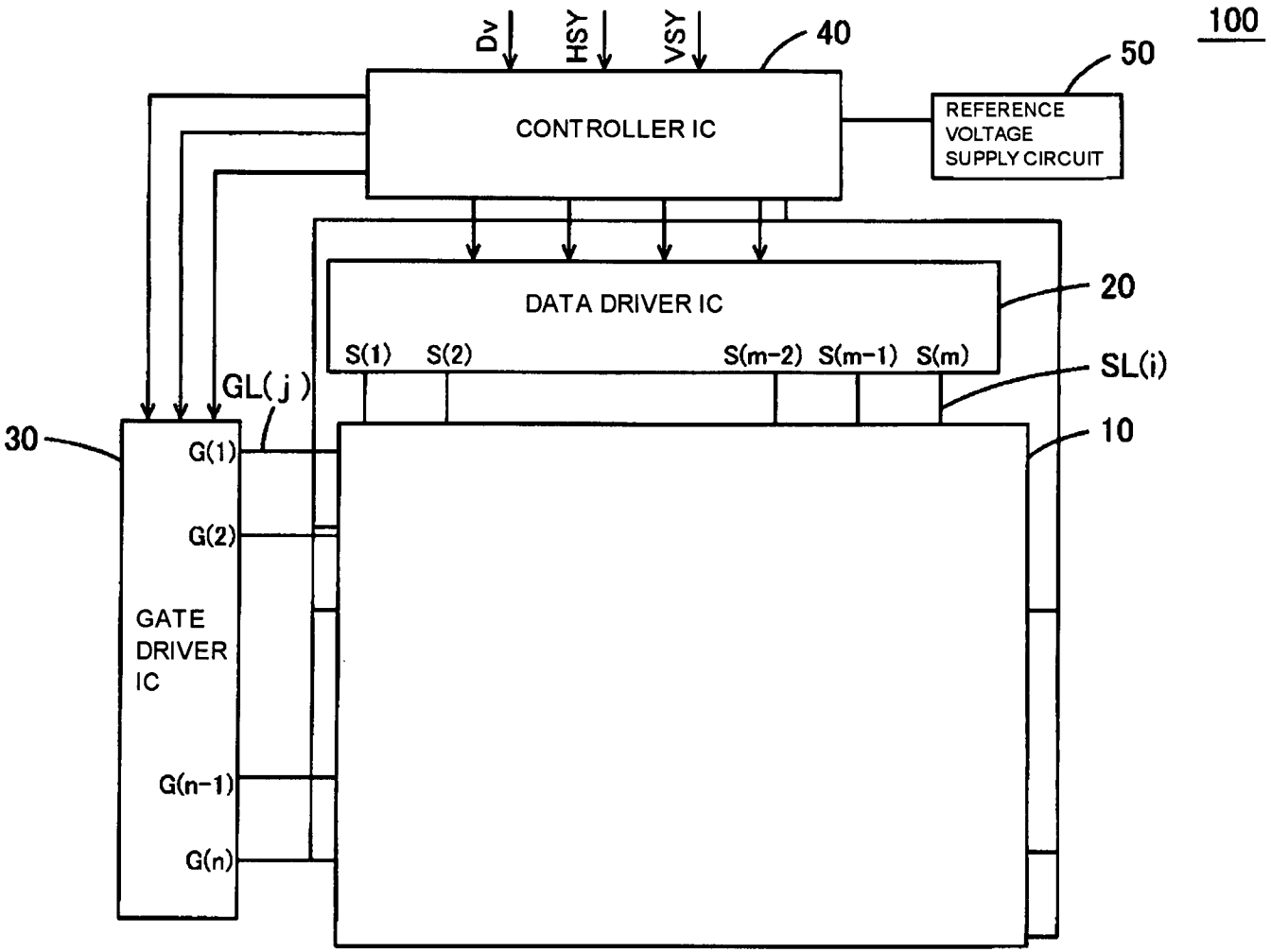
FIG. 1 is a block diagram illustrating an exemplary liquid crystal display device 100.

FIG. 1 is a block diagram of the liquid crystal display device 100. The liquid crystal display device 100 includes a display panel 10 to display an image, a source driver IC 20 to generate a source voltage Vs based on an image signal, a gate driver IC 30 to select a pixel column to be scanned, and a controller IC 40 to control driving of the source driver IC 20 and driving of the gate driver IC 30.

Figure 2:
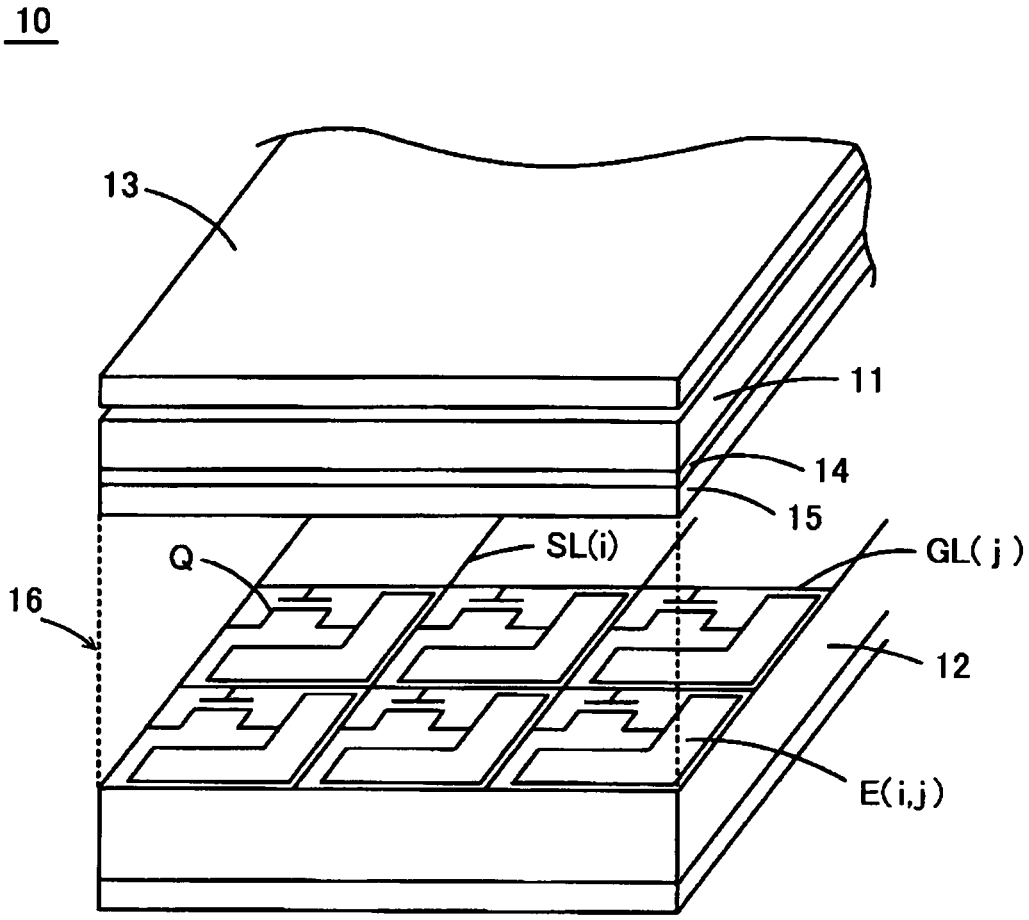
FIG. 2 is a perspective view illustrating an exemplary display panel.

FIG. 2 is a perspective view of the display panel. The display panel 10 includes two glass substrates 11, 12, a liquid crystal layer 16 sandwiched between these glass substrates 11, 12, and a polarizing plate 13 to polarize light. On one glass substrate 11, color filters 14 separating light passing through the display panel 10 into R (red), G (green) and B (blue) colors and a counter electrode 15 to which a common voltage Vcom is applied are situated. On the other glass substrate 12, a thin film transistor (TFT) Q as a switch element, a display electrode E (i, j) which is connected to a drain electrode of the thin film transistor Q and to which a source voltage is applied, a source line SL (i) connecting an output terminal S (i) of the source driver IC 20 to a source electrode of the thin film transistor Q, and a gate line GL (j) connecting an output terminal G (j) of the gate driver IC 30 to a gate electrode of the thin film transistor Q are disposed.

As shown in FIG. 2, pixels P are formed by the counter electrode 15 situated on the glass substrate 11, display electrodes E (i, j) disposed on the glass substrate 12, and the liquid crystal layer 16 sandwiched between the counter electrode 15 and the display electrodes E (i, j). The display panel 10 has a screen in which the pixels (i, j) are arranged in a matrix, wherein resolution depends on the number of pixels. The liquid crystal layer 16 is filled with a liquid crystal material in which molecular arrangement varies depending on a voltage applied thereto. Each pixel P (i, j) is driven by applying a drive voltage Vd to the liquid crystal material, the drive voltage Vd corresponding to a potential difference between a source voltage Vs applied to the display electrode E (i, j) for that pixel and a common voltage Vcom applied to the counter electrode 15. In the present embodiment, ITO (Indium Tin Oxide) is assumed as the material of the counter electrode 15 and the display electrodes E (i, j), where i and j denote x and y coordinate values to identify the position of each pixel in the matrix.

Figure 3:
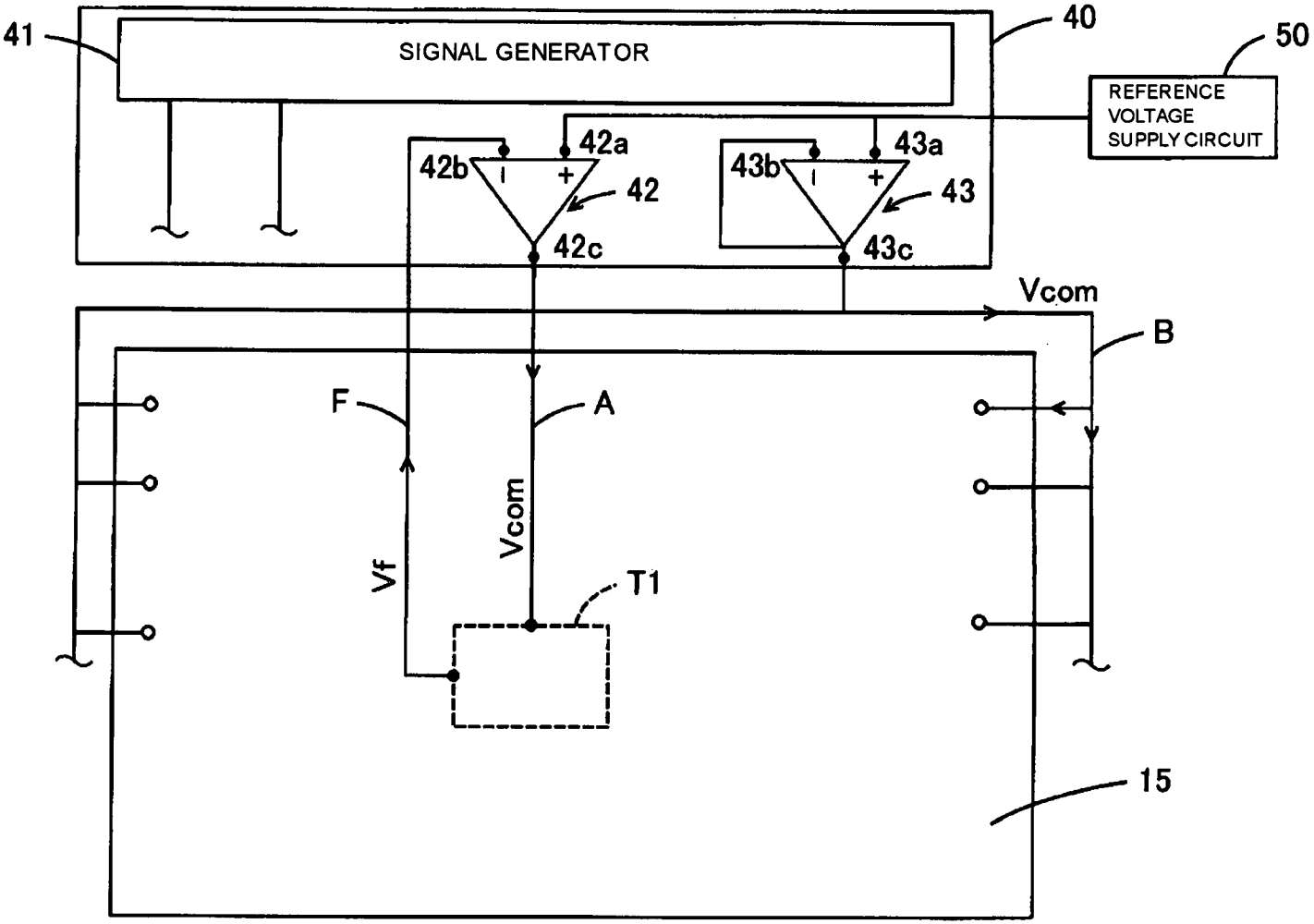
FIG. 3 is a block diagram illustrating an exemplary configuration of a controller IC.

The controller IC 40 acquires a video signal and a synchronization signal from an external device (not shown) and generates a certain signal to control the source driver IC 20 and the gate driver IC 30. The controller IC 40 is also responsible for feedback control of a common voltage Vcom that is applied to the counter electrode 15. FIG. 3 is a block diagram of the controller IC. Referring to FIG. 3, the controller IC 40 includes a signal generator 41 which generates a control signal based on a received signal, an operational amplifier 42 (a common voltage supplying part) which feedback controls a common voltage Vcom in a certain area of the counter electrode 15 and applies Vcom to the counter electrode 15, and an operational amplifier 43 which applies a common voltage Vcom to the counter electrode 15.

The signal generator 41 receives from the external device a digital video signal Dv for an image to be displayed as well as a horizontal synchronization signal HSY and a vertical synchronization signal VSY for the digital video signal Dv and generates a signal to control the source driver IC 20 and the gate driver IC 30. In particular, the signal generator 41 generates a latch pulse LP, a source driver start signal SSP, a source driver clock signal SCK, and a digital image signal DA and supplies these generated signals to the source driver IC 20. The controller IC 40 (signal generator 41) also generates a gate driver start signal GSP and a gate driver clock signal GCK and supplies these generated signals to the gate driver IC 30.

The operational amplifier 42 compares a feedback voltage Vf based on the charge in a certain area of the counter electrode 15 with a reference voltage Vref and feedback controls a common voltage Vcom based on the result of the comparison. A first input terminal 42*a* of the operational amplifier 42 is connected to a reference voltage supply circuit 50 that generates a reference voltage Vref and a second input terminal 42*b* of the operational amplifier 42 is connected to a conductor wire F. The other end of the conductor wire F is connected to an area T1 of the counter electrode 15 facing the display electrodes E (a, b) for pixels P (a, b) in the center of the display panel 10. An output terminal 42*c* is connected to the area T1 of the electrode 15 through a transmission line A. The output terminal 42*c* supplies a feedback voltage Vf based on the voltage in the area T1 to the second input terminal 42*b* of the operational amplifier 42. The area of the counter electrode to which the conductor wire F is connected may be an area where a large pulsation of the common voltage Vcom occurs, which is which is not limited to the area T1.

The operational amplifier 42 has a large input impedance, making current hard to flow in the operational amplifier 42. Thus, even if the conductor wire F as the feedback line connected to the second input terminal 42*b* is narrow and its wiring resistance is large, the operational amplifier 42 can operate correctly. For a type of display panel in which conductor wires are wired on the glass substrate such as LOG (Line On Glass), this produces an effect that makes the conductor wire F invisible, not degrading the aperture ratio of the glass substrate. The conductor wire F is a realization of a feedback voltage supplying part.

The operational amplifier 43 applies a common voltage Vcom to the counter electrode 15 based on a reference voltage Vref supplied from the reference voltage supply circuit 50. A first input terminal 43*a* of the operational amplifier 43 is connected to the reference voltage supply circuit 50. A second input terminal 43*b* of the operational amplifier 43 is connected to an output terminal 43*c* and the operational amplifier 43 provides a negative feedback control. The output terminal 43*c* is also connected to a transmission line B that provides connections from the areas at both lateral sides of the display panel 10 to the counter electrode 15. Therefore, through the transmission line B, the operational amplifier 43 supplies a common voltage Vcom to the counter electrode 15 from both side areas of the display panel 10.

The source driver IC 20 generates a source voltage Vs that is applied to the display electrodes E (i, j). The source driver IC 20 includes a sampling memory, a hold memory, and an output circuit. Digital image signals DA supplied by the controller IC 40 to the source driver IC 20 are sequentially stored into the sampling memory in synchronization with input timing of a latch pulse LP. After all digital image signals DA are stored in the sampling memory, when a source driver start pulse is output, the digital image signals DA are transferred in a batch from the sampling memory into the hold memory. Then, the digital image signals DA are passed to the output circuit, where they are digital-to-analog converted based on a gray level voltage and output as source voltages Vs. The output circuit applies the source voltages Vs from the output terminals S (i) of the source driver IC 20 through the source lines (SL) i to the source electrodes of the thin film transistors Q.

The gate driver IC 30 generates a gate signal that turns a thin film transistor on. The gate driver IC 30 includes n stages of shift registers and a level converter which outputs gate signals. When a gate driver start signal GSP and a gate driver clock signal GCK supplied from the controller IC 40 are input to each shift register, each shift register takes in the gate driver start signal GSP at a rise timing of the gate driver clock signal GCK and shifts the first bit in order at a fall timing of the gate driver clock signal GCK. The shift registers sequentially output each bit as a gate signal to the gate lines GL (j).

The following description will explain the operation of the liquid crystal display device embodied as described above.

When digital video signals Dv and a horizontal synchronization signal HSY and a vertical synchronization signal VSY are supplied from the external device to the controller IC 40, the controller IC 40 generates the above-mentioned signals and supplies the generated signals to the source driver IC 20 and the gate driver IC 30. The source driver IC 20 supplies source voltages Vs to the source electrodes of the thin film transistors Q through the source lines SL (i). The gate driver IC 30 supplies gate signals to the gate electrodes of the thin film transistors Q through the gate lines GL (j). Thus, the gate signals applied to the gate electrodes of the thin film transistors Q through the gate lines GL (j) turn the thin film transistors Q on and the source voltages are applied to the display electrodes E (i, j) connected to the drain electrodes of the thin film transistors Q. In this way, the source driver IC 20, the gate driver IC 30, and the controller IC 40 realize a source voltage supplying part.

Also, the controller IC 40 supplies a common voltage Vcom to the counter electrode 15 through the transmission lines A, B. Consequently, to the liquid crystal layer 16 for a pixel P (i, j), a drive voltage Vs is applied, the drive voltage Vs corresponding to a potential difference between the source voltage Vs applied to the corresponding display electrode E (i, j) and the common voltage Vcom applied to the counter electrode 15. Meanwhile, the common voltage Vcom applied to the area T1 of the counter electrode 15 to which the conductor wire F is connected is feedback controlled by the operational amplifier 42 and supplied again to the counter electrode 15.

1.2 Effect of Liquid Crystal Display Device

Figure 4:
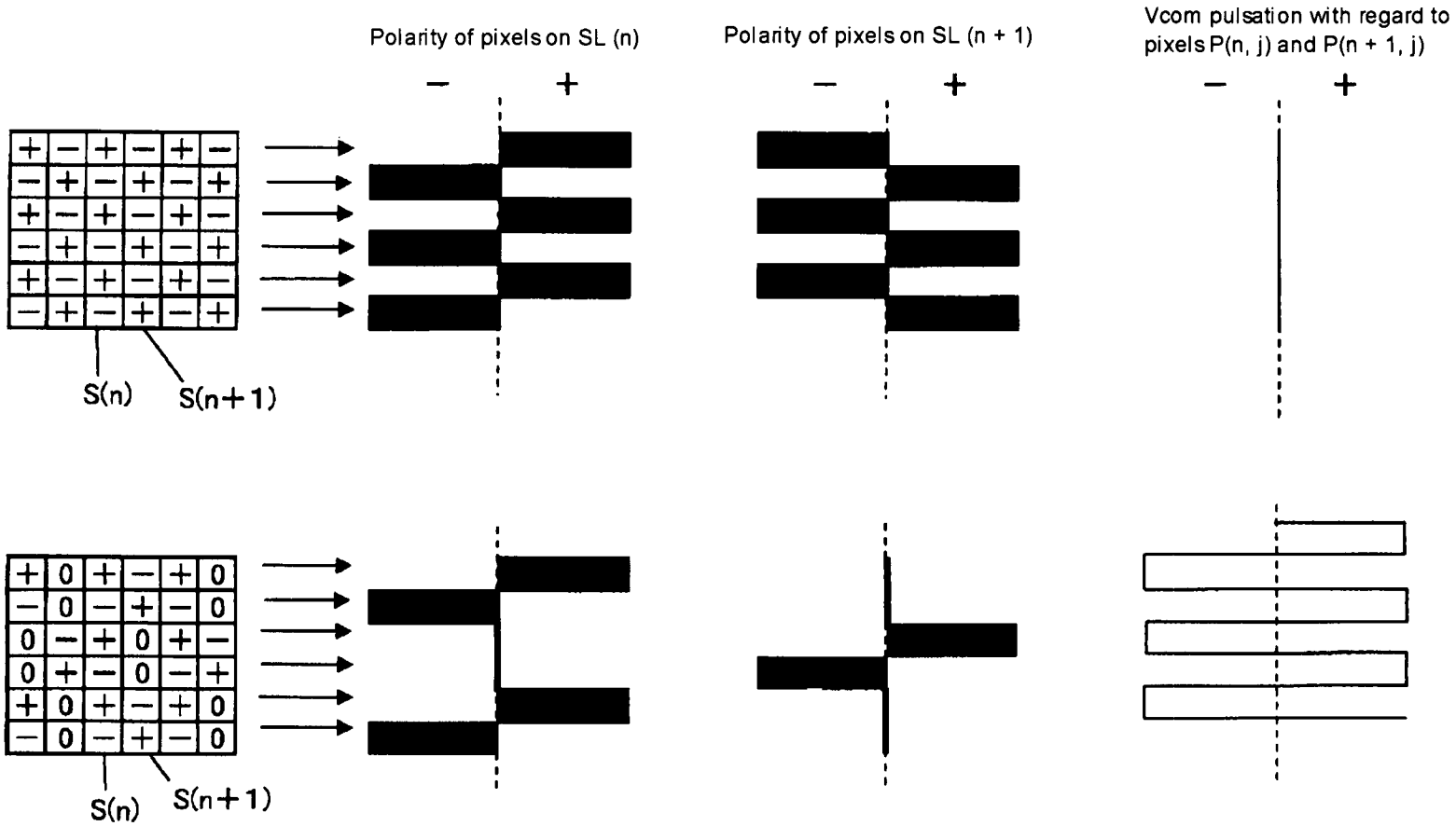
FIG. 4 represents, by way of example, a relationship between the polarity of pixels and pulsation of a common voltage Vcom in a 1×1 dot inversion driving method.

The following description will explain the effect of the liquid crystal display device 100 using the 1×1 dot inversion driving method to drive the liquid crystal. FIG. 4 represents a relationship between the polarity of pixels and pulsation of a common voltage Vcom in the 1×1 dot inversion driving method.

As shown in the upper portion of FIG. 4, in the case of the 1×1 dot inversion driving method, for pixels P (n, j) and pixels P (n+1, j) to which a source line SL (n) and a source line SL (n+1) are connected, source voltages Vs of opposite polarities are applied to every pair of adjacent pixels in the horizontal direction. At this time, as shown in the lower portion of FIG. 4, if the liquid crystal is driven so that pixels to drive are switched in every 1×2 pixels (for convenience, a pixel not to drive is represented as 0), the common voltage Vcom pulsates with polarity inversion per horizontal cycle. Consequently, the pulsation of the common voltage Vcom becomes larger in a certain area of the counter electrode 15 in a relation to impedance that varies across the counter electrode. Driving by the 1×1 dot inversion driving method is only exemplary; the driving method to be applied could be different from this method.

Figure 5:
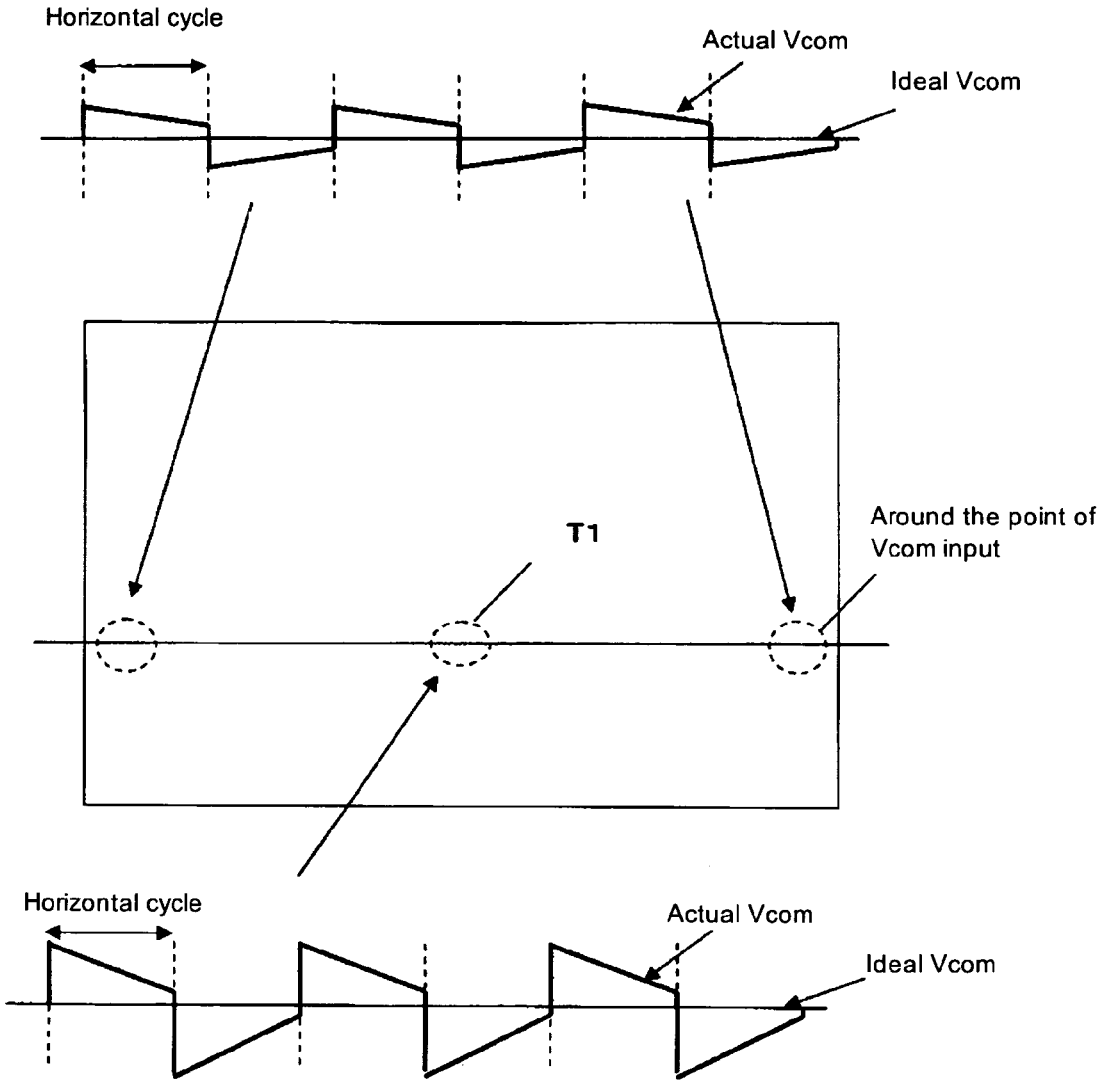
FIG. 5 is a diagram to explain the pulsations of a common voltage Vcom.
Figure 6:
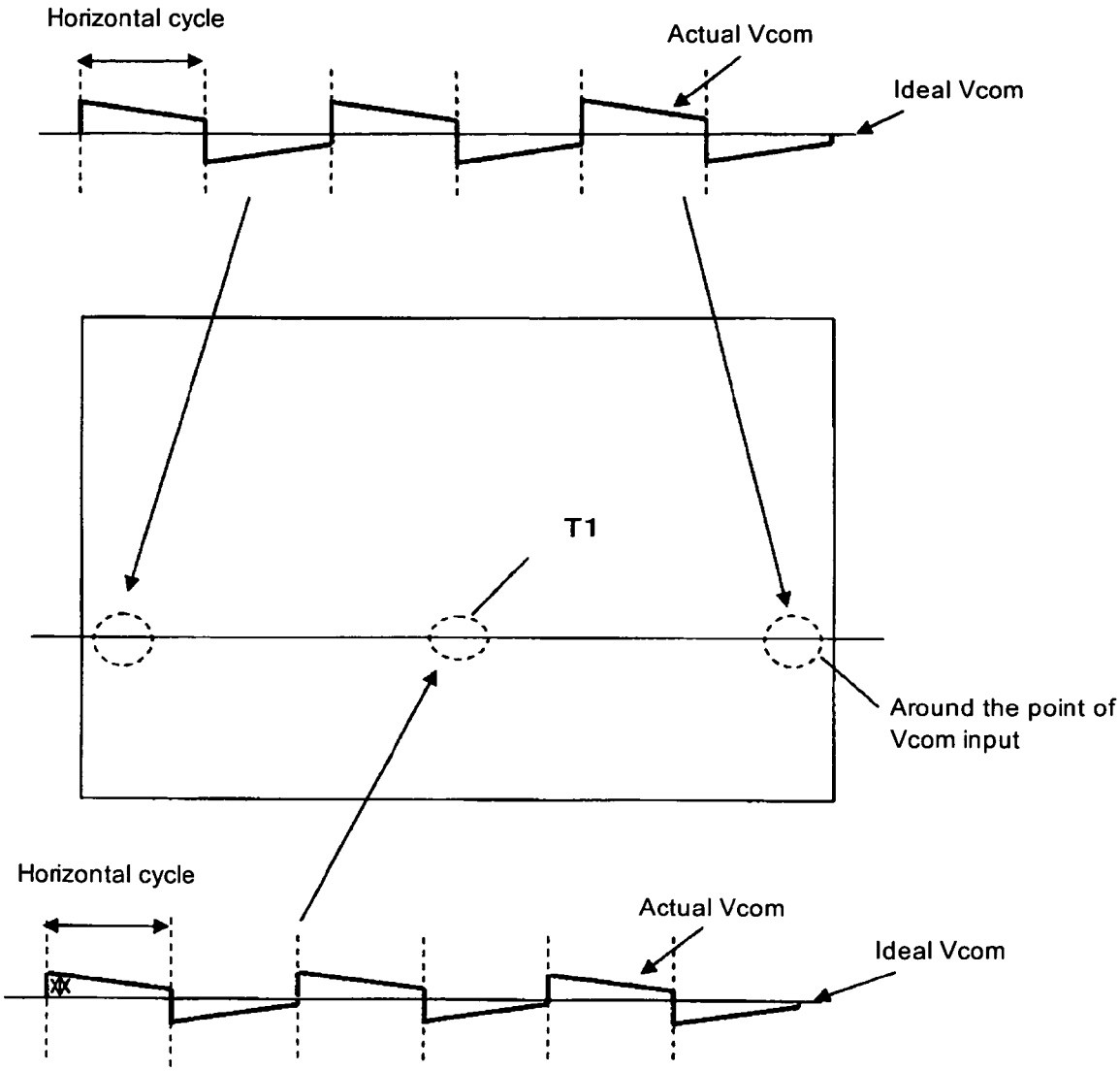
FIG. 6 is a diagram to explain the pulsations of a common voltage Vcom.

FIGS. 5 and 6 are diagrams to explain the pulsations of a common voltage Vcom. FIG. 5 shows the pulsations of a common voltage Vcom in different portions of the counter electrode, when feedback control is not applied. FIG. 6 shows the pulsations of a common voltage Vcom in different portions of the counter electrode, when feedback control is applied. A waveform profile in the upper portion of each figure represents the pulsation of a common voltage Vcom around an input point of common voltage Vcom. A waveform profile in the lower portion represents the pulsation of a common voltage Vcom in the area T1 of the counter electrode 15.

The impedance of the counter electrode 15 around an input point is smaller than that in the area T1 which is positioned virtually in the center of the counter electrode. Therefore, the pulsation of a common voltage Vcom around the input point is smaller. On the other hand, the impedance in the area T1 virtually in the center of the counter electrode is larger. Therefore, the amplitude of the pulsation of a common voltage Vcom becomes larger, as shown in the lower portion of FIG.

5, in the case that feedback control is not applied. By contrast, in the case that feedback control of the common voltage Vcom supplied to the area T1 is applied, the amplitude of the pulsation of the common voltage Vcom is reduced due to feedback control, as shown in the lower portion of FIG. 6.

Figure 7:
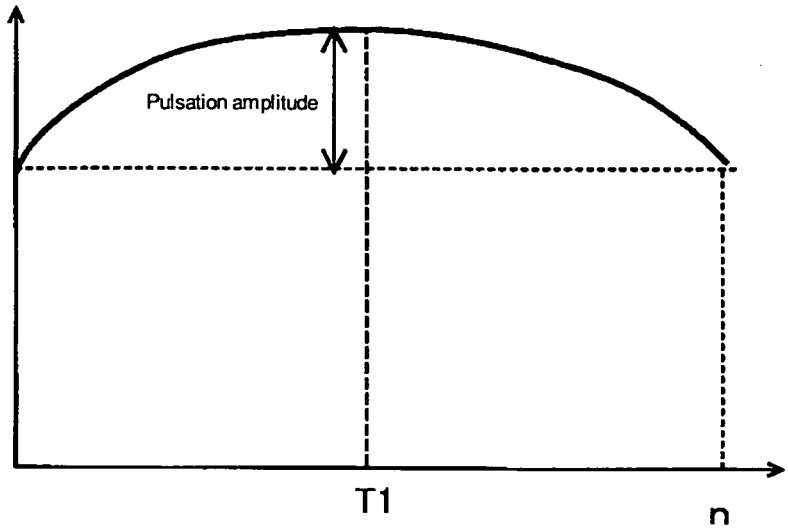
FIG. 7 is a graph to explain distribution of the pulsation amplitude of a common voltage Vcom for one scan line.
Figure 8:
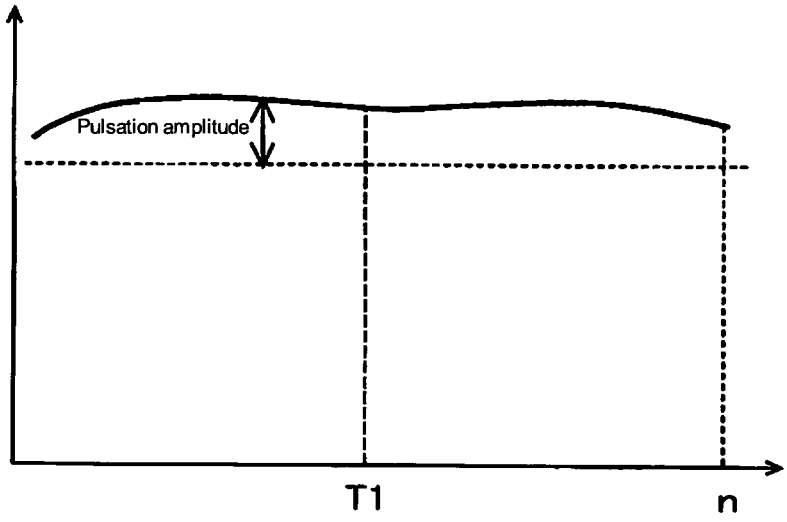
FIG. 8 is a graph to explain distribution of the pulsation amplitude of a common voltage Vcom for one scan line.

FIGS. 7 and 8 are graphs to explain distribution of the pulsation amplitude of the common voltage Vcom for one scan line. In each graph, the abscissa denotes a sequence of counter electrode 15 areas corresponding to the pixels (i, b), where i=1 to n, connected to a particular gate line GL (b). The ordinate denotes the pulsation amplitude of the common voltage Vcom. FIG. 7 shows the pulsation amplitude in the case that the common voltage Vcom applied to the area T1 positioned virtually in the center of the counter electrode 15 is not feedback controlled. FIG. 8 shows the pulsation amplitude in the case that the common voltage Vcom in the area T1 is feedback controlled.

As shown in FIG. 7, when the common voltage Vcom is supplied through the transmission line B from both lateral sides of the display panel 10, the pulsation amplitude of the common voltage Vcom becomes peak in the area T1. On the other hand, when the common voltage Vcom in the area T1 is feedback controlled, the pulsation amplitude of the common voltage Vcom in the area T1 is reduced, as shown in FIG. 8. Accordingly, the pulsation amplitude across the counter electrode 15 for one scan line becomes smaller. In this way, in the present embodiment, due to that the operational amplifier 42 feedback controls the common voltage Vcom with a large pulsation amplitude, it is possible to reduce the pulsation amplitude of the common voltage Vcom across the counter electrode 15.

Figure 9:
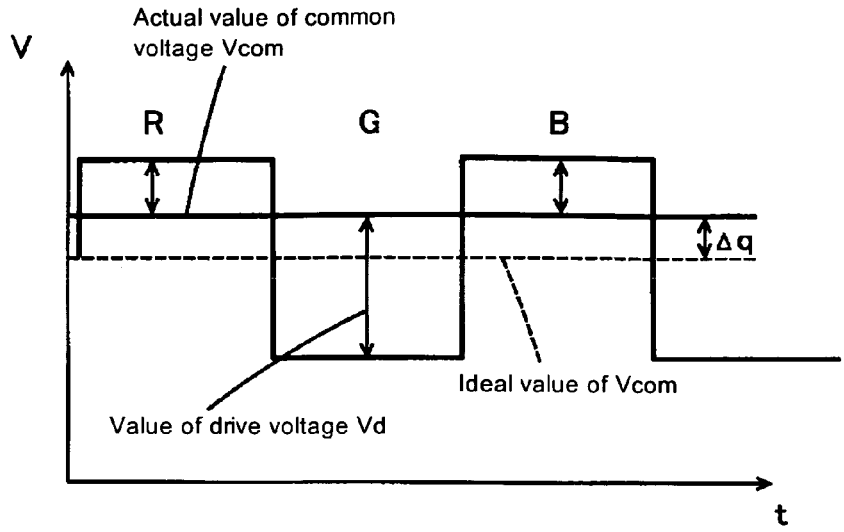
FIG. 9 is a graph to explain a drive voltage Vd applied to each of adjacent pixels P (i, j) fitted with R, G, and B color filters respectively.
Figure 10:
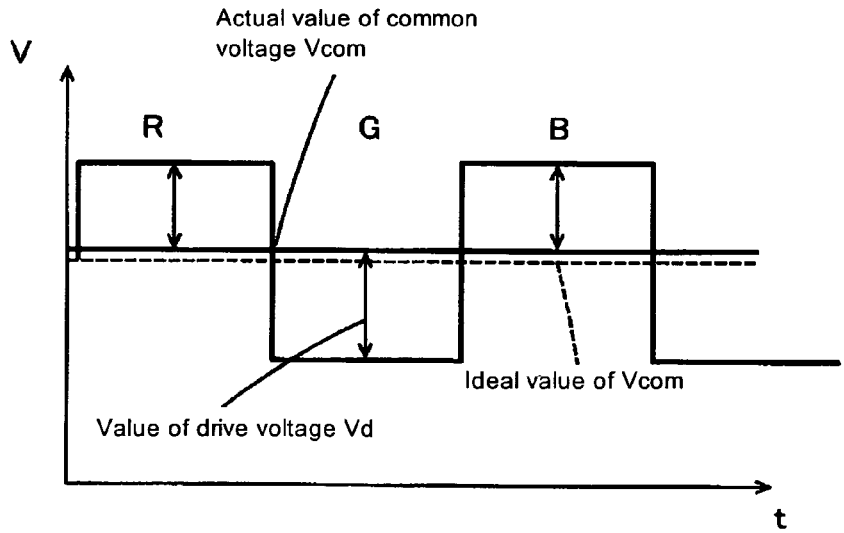
FIG. 10 is a graph to explain a drive voltage Vd applied to each of adjacent pixels P (i, j) fitted with R, G, and B color filters respectively.

FIGS. 9 and 10 are graphs to explain a drive voltage Vd applied to each of adjacent pixels P (i, j) fitted with R, G, and B color filters respectively. The pixels discussed in this example are those in the area where the common voltage Vcom has a large pulsation amplitude. It is assumed that, as an image signal, a checkered pattern image signal is supplied to the controller IC 40. Driving the display panel 10 is performed by a dot inversion driving method wherein voltages of opposite polarities are applied to every pair of R, G, B adjacent pixels. FIG. 9 shows drive voltage Vd values applied to R, G, B pixels in the case that feedback control of a common voltage Vcom is not applied. FIG. 10 shows drive voltage Vd values applied to R, G, B pixels in the case that feedback control of a common voltage Vcom is applied.

As shown in FIG. 9, the drive voltage Vd applied to the liquid crystal layer 16 has a value that corresponds to a potential difference between the source voltage Vs applied to each pixel and the common voltage Vcom. As seen from FIG. 9, the absolute value of the drive voltage Vd that is applied to the liquid crystal layer for a pixel Pg (i, j) fitted with a G color film is larger than the absolute values of the drive voltage Vd that is applied to the liquid crystal layer for pixels Pr, Pb fitted with R and B color films. As implied from FIG. 9, consequently, among the adjacent R, G, and B pixels, the pixel fitted with the G (green) color filter has a higher light transmittance, which produces an area where a G (green) tone is distinct on the screen.

As shown in FIG. 10, in the case of feedback control of a common voltage Vcom is applied, the common voltage Vcom value changes to approach an ideal common voltage Vcom value and the values of the drive voltage Vd for each of adjacent R, G, B pixels become uniform. Accordingly, unbalance of the tones of R, G, B pixels is avoided, uneven image quality in the screen is prevented, and display quality is improved.

2. Second Embodiment

In the foregoing first embodiment, feedback control of a common voltage Vcom value for a certain subset of pixels P (i, j) is performed using one operational amplifier. However, in a case where a larger counter electrode is used as in a liquid crystal display device for a large screen, the LCD device may be adapted to implement Vcom feedback control individually in a plurality of areas of the counter electrode using a plurality of operational amplifiers.

Figure 11:
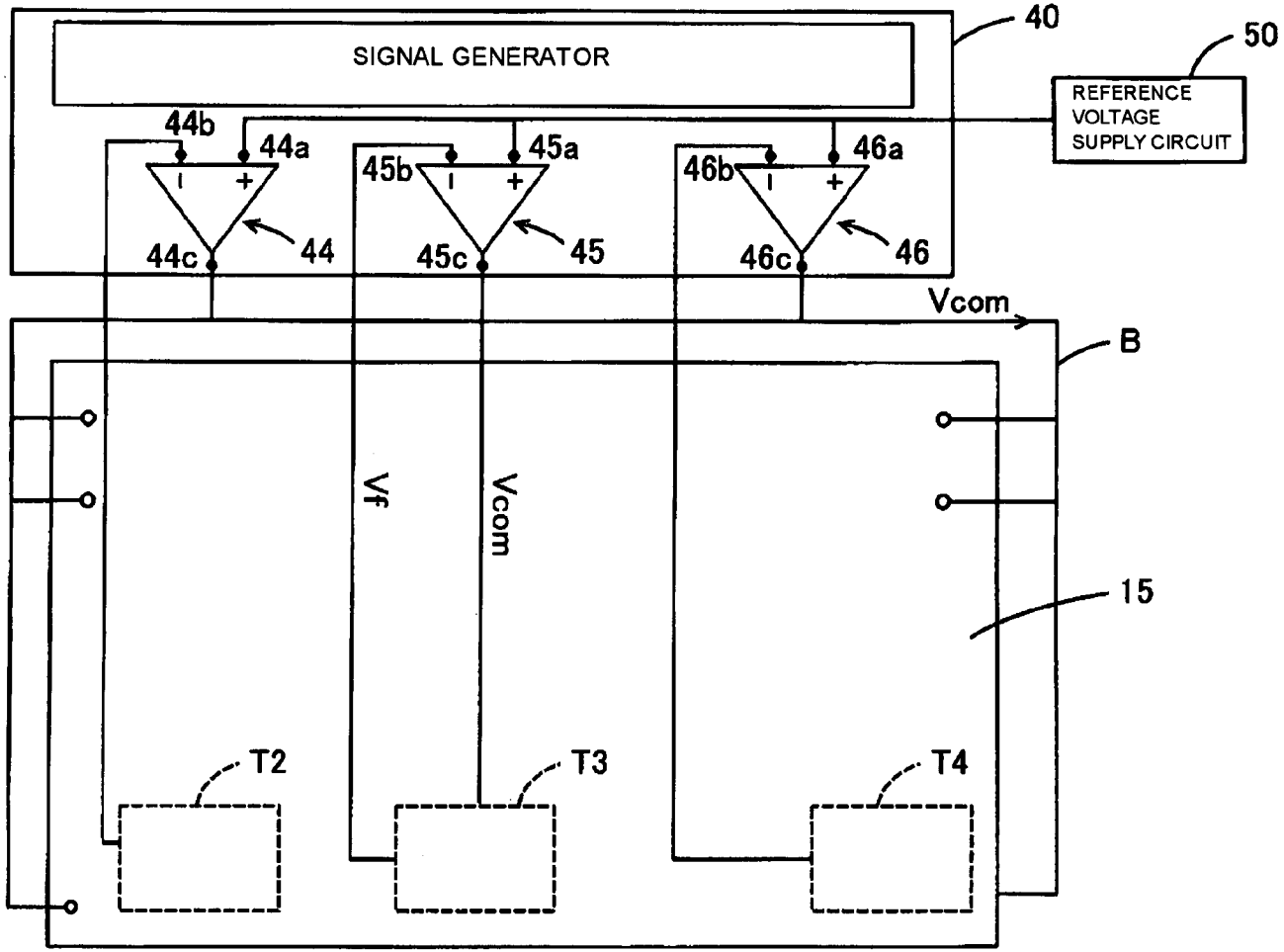
FIG. 11 is a block diagram illustrating the structure of a liquid crystal display device 100 in a second embodiment.

FIG. 11 is a block diagram of a liquid crystal display device 100. This device has the same structure as shown in FIG. 1, though the gate driver IC is omitted from FIG. 11 for the sake of simplicity. Operational amplifiers 44 to 46 are responsible for feedback control of a common voltage Vcom that is applied in both lateral marginal areas and a virtually center area of the counter electrode 15. In particular, the operational amplifier 44 feedback controls the common voltage Vcom applied in an area T2 of the counter electrode 15 marked at lower left. The operational amplifier 46 feedback controls the common voltage Vcom applied in an area T4 of the counter electrode 15 marked at lower right. And, the operational amplifier 45 feedback controls the common voltage Vcom applied in an area T5 of the counter electrode 15 marked at lower center. The first input terminals 44*a* to 46*a* of the operational amplifiers 44 to 46 are connected to the reference voltage supply circuit 50, so that feedback control of the common voltage Vcom in each area T2 to T4 is performed, based on the reference voltage Vref of the same potential.

Figure 12:
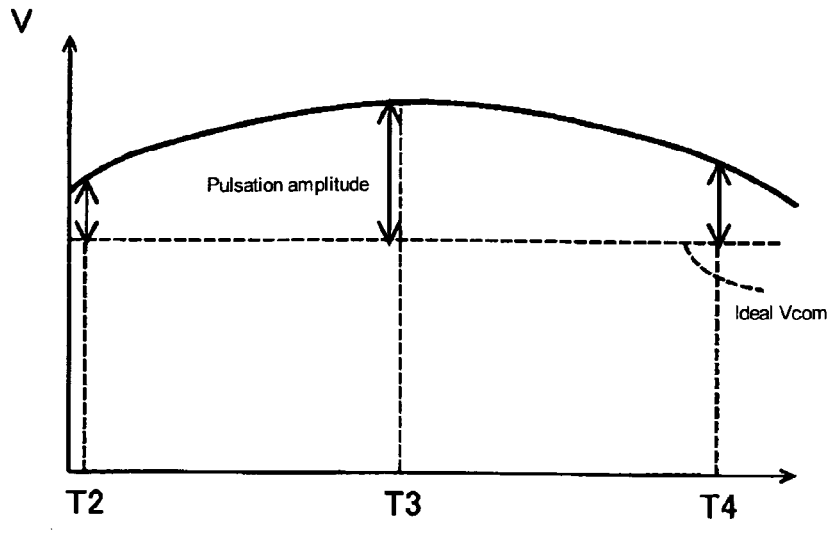
FIG. 12 is a graph to explain distribution of a common voltage Vcom across the counter electrode in the second embodiment.
Figure 13:
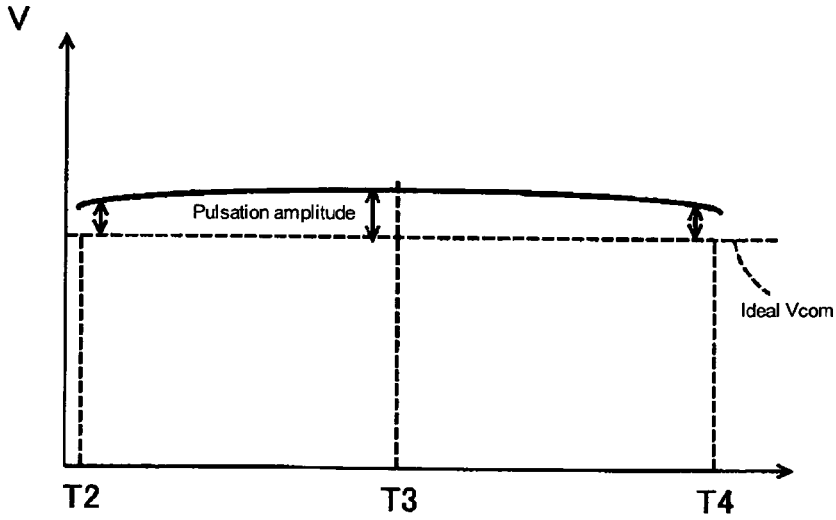
FIG. 13 is a graph to explain distribution of a common voltage Vcom across the counter electrode in the second embodiment.

FIG. 12 and FIG. 13 are graphs to explain distribution of the pulsation amplitude of the common voltage Vcom for one scan line in the second embodiment. A dotted line denotes an ideal common voltage Vcom. As shown in FIG. 12, the pulsation of the common voltage Vcom in the area T3 becomes largest in the case that feedback control is not applied. On the other hand, in the case that feedback control of the common voltage Vcom in the areas T2, T3, T4 is applied, as shown in FIG. 13, the pulsation of the common voltage Vcom across the counter electrode 15 is reduced. At this time, the operational amplifiers 44 to 46 perform feedback control of the common voltage Vcom based on the same reference voltage Vref. Accordingly, this feedback control provides a uniform value of the common voltage Vcom, prevents uneven image quality in the screen, and improves display quality.

3. Modification Examples

There are examples of various modifications of the present invention. As an example of a liquid crystal driving method, in addition to the described 1×1 dot inversion driving method, a 1×2 dot inversion driving method and a column inversion driving method may be used.

The liquid crystal display device of the present invention may be a television receiver with a tuner for receiving TV broadcasting.

Needless to say, the present invention is not limited to the above-described embodiments. It will be obvious to those skilled in the art that variants may be considered to be involved in embodiments of the present invention disclosed herein by applying the following:

Appropriately changing combinations of elements, components, and the like, which are mutually replaceable, disclosed in the above-described embodiments Appropriately using or changing combinations of elements, components, and the like which are not disclosed in the above-described embodiments, but are known to those skilled in the art and mutually replaceable with the elements, components, and the like disclosed herein.

Appropriately using or changing combinations of elements, components, and the like which are not disclosed in the above-described embodiments, but may be considered by those skilled in the art as alternatives to the elements, components, and the like disclosed herein based on common knowledge.

While the invention has been particularly shown and described with respect to preferred embodiments thereof, it should be understood by those skilled in the art that the foregoing and other changes in form and detail may be made therein without departing from the spirit and scope of the invention as defined in the appended claims.

What is claimed is:

1. A liquid crystal display device, comprising:

pixels that are formed by a liquid crystal layer;

display electrodes disposed across the liquid crystal layer;

a counter electrode made of a transparent material, and which displays an image by applying a drive voltage to the liquid crystal layer, the drive voltage corresponding to a potential difference between each of the display electrodes and the counter electrode;

a source voltage supplying part that supplies source voltages based on image signals to the display electrodes;

a feedback voltage supplying part that outputs a feedback voltage corresponding to a potential in a virtually center area of the counter electrode; and a first common voltage supplying part that supplies the common voltage to at least one edge of the counter electrode, a second common voltage supplying part that compares the feedback voltage with a reference voltage, feedback controls the common voltage based on the result of the comparison, and supplies the thus controlled common voltage to the virtually center area of the counter electrode; wherein the feedback voltage supplying part comprises a first conductive wire, and one end of the first conductive wire is directly connected to the virtually center area of the counter electrode, the virtually center area is a horizontally center of the counter electrode located at the same distance from both horizontal edges of the counter electrode, and a vertically center of the counter electrode located at the same distance from both vertical edges of the counter electrode, the virtually center of the counter electrode is an area where a large pulsation of the common voltage occurs.

2. The liquid crystal display device according to claim 1, wherein the feedback voltage supplying part comprises a second conductive wire, and one end of the second conductive wire is directly connected to a different position from the virtually center area of counter electrode, the different position is located horizontally same as the virtually center area of counter electrode, the first common voltage supplying part feedback controls the common voltage based on the feedback voltage outputted from the second conductive wire.

* * * * *